US005794782A

United States Patent [19]

Ascik

[11] Patent Number: 5,794,782

[45] Date of Patent: *Aug. 18, 1998

[54] MERCHANDISE TRANSPORT, STORAGE AND DISPLAY APPARATUS AND SYSTEM

[75] Inventor: Mark A. Ascik, Ormond Beach, Fla.

[73] Assignee: Capo, Inc., Ormond Beach, Fla.

[ * ] Notice: This patent issued on a continued prosecution application filed under 37 CFR 1.53(d), and is subject to the twenty year patent term provisions of 35 U.S.C. 154(a)(2).

[21] Appl. No.: 602,660

[22] Filed: Feb. 16, 1996

[51] Int. Cl.[6] ..... B65D 19/00

[52] U.S. Cl. ..... 206/600; 206/730; 211/85.1

[58] Field of Search ..... 206/386, 597, 206/600, 5, 730, 734; 211/13, 85.1; 248/902; 312/138.1, 109, 265.1

[56] References Cited

U.S. PATENT DOCUMENTS

| | | | |
|---|---|---|---|
| 3,817,392 | 6/1974 | Bloch . | |
| 3,891,092 | 6/1975 | Surrette et al. . | |
| 4,040,520 | 8/1977 | Joaquin . | |
| 4,140,223 | 2/1979 | Rau et al. . | |
| 4,211,331 | 7/1980 | Salmon et al. . | |
| 4,609,975 | 9/1986 | Badolato et al. . | |
| 4,673,090 | 6/1987 | Crosslen . | |
| 4,753,495 | 6/1988 | Swink . | |
| 4,760,927 | 8/1988 | Dechirot . | |
| 4,850,658 | 7/1989 | Sandor | 211/13 |
| 4,940,297 | 7/1990 | Borgen | 312/138.1 |
| 5,016,761 | 5/1991 | Stoddard et al. | 206/597 |
| 5,257,703 | 11/1993 | Ascik et al. . | |
| 5,280,839 | 1/1994 | Crampton . | |
| 5,383,722 | 1/1995 | Chen | 312/138.1 |
| 5,507,237 | 4/1996 | Barrow et al. | 206/600 |

*Primary Examiner*—Paul T. Sewell
*Assistant Examiner*—Nhan T. Lam
*Attorney, Agent, or Firm*—Hopgood, Calimafde, Kalil & Judlowe, LLP

[57] ABSTRACT

A merchandise transport, storage and display apparatus comprising a base assembly, a frame assembly engaged to said base assembly, panel means removingly engaged to said frame assembly, a plurality of cooperative positioning means engaged to said base assembly, frame assembly and alternatively said panel means for positioning a plurality of merchandise receptacles within said frame assembly providing a modularized apparatus and system for the transport, storage, display and replenishment of merchandise.

26 Claims, 4 Drawing Sheets

MERCHANDISE TRANSPORT, STORAGE AND DISPLAY APPARATUS AND SYSTEM

BACKGROUND OF THE INVENTION

1. Field of the Invention

The present invention relates generally to merchandise display apparatus. More particularly, the present invention relates to free-standing, high-capacity, merchandise floor displays particularly adapted for eyewear and eyewear accessories and a system for displaying, transporting, storing and replenishing the inventory of said eyewear. While the present invention is directed generally to the field of eyewear display apparatus, it can be readily understood that application of the invention can be readily extended to the display of other merchandise without detracting materially from the spirit and scope of the invention.

2. Description of the Prior Art

In the field of merchandise displays and particularly, eyeglass/sunglass displays, typical display stands include the carousel-type counter top displays, the free-standing rotatable displays and free-standing, fixed floor displays commonly found in most department and retail stores. Example prior art patents covering these types of displays include U.S. Pat. No. 4,211,331 issued to Salmon, et. al., U.S. Pat. No. 4,609,975 issued to Bodolato, U.S. Pat. No. 3,891,092 issued to Surrette et. al., U.S. Pat. No. 4,753,495 issued to Swink, U.S. Pat. No. 5,280,839 issued to Crampton, U.S. Pat. No. 4,140,223 issued to Rau, et. al., U.S. Pat. No. 4,673,090 issued to Crosslen, U.S. Pat. No. 4,760,927 issued to Dechirot and U.S. Pat. No. 5,257,703 issued to Ascik, et. al.

In the retail sales area, a particular problem for retailers is that a significant amount of labor is required for the initial loading of merchandise displays and the subsequent replenishing of sold inventory. In addition, retailers find it difficult to move large, heavy, high-capacity displays when stocked or which have multiple component parts which must be removed of dismantled before the display is relocated or withdrawn from the floor during off-season periods. Furthermore, many displays have little or insufficient surface area for the placement of attractive sales and marketing information or reflective surfaces such as mirrors for use by customers.

Accordingly, it is important for the retailer to be able to obtain a merchandise display which is pre-loaded with inventory in sufficient quantities to meet peak and seasonal demand periods, which requires little labor in the way of stocking and replenishing of inventory, which is easy to move when loaded with inventory and which includes sufficient surface areas for the placement of attractive marketing and sales information and reflective surfaces for use by potential purchasers.

Existing displays do not meet this criteria. Therefore, there exists a need in the art for a high capacity merchandise display which can be preloaded with inventory, which includes a sufficient quantity of stored inventory in receptacle means which permits a system of quick and easy replenishment of sold merchandise, which includes integral means for ease of transport of the display and which includes sufficient surface area for the presentation of collateral marketing and sales information and/or reflective surfaces for use by customers.

SUMMARY OF THE INVENTION

The present invention comprises a free-standing, high-capacity, vertically oriented, rectangular merchandise floor display apparatus for universal presentation of merchandise on all sides. The display apparatus includes a modularized merchandise receptacle system for the transport, storage and display of merchandise combined within a compartmented single display unit. Accordingly, the display apparatus is particularly adapted and suitable for eyewear and eyewear accessories.

The apparatus includes an integral pallet base assembly for ease of lifting and transportation while loaded or unloaded with merchandise. Engaged to the pallet base assembly is a light-weight, frame assembly having internal positioning means attached thereto for the strategic, internal placement of a plurality of likewise vertically oriented, but horizontally stacked merchandise receptacles.

The merchandise receptacles are pre-loaded with merchandise by the manufacturer or distributor before insertion into the display and shipment to the retailer. The merchandise receptacles are inserted, removed and/or repositioned in the display apparatus through removable or hinged side access panels or alternatively slid through the top of the display. The merchandise receptacles can be universally repositioned, removed and/or replaced depending on the retailer's inventory requirements providing for a modularized system for transportation, storage and display of merchandise requiring minimal labor effort.

The exterior surfaces of the side access panels provide large surface areas for the placement of marketing information and reflective surfaces such as mirrors.

A removably engaged cover means is also provided to cover the pallet base assembly of the display during presentation at the retail store location for a more attractive appearance.

List of Advantages:

One of the principal advantages of the present invention is to provide a free-standing, high-capacity merchandise display which is capable of being pre-loaded with merchandise and shipped to the retailer as one integral display unit.

It is another advantage of the present invention to provide a free-standing, high-capacity merchandise display which includes an integral means for lifting and transporting the display while loaded or unloaded.

It is a further advantage of the present invention to provide a free-standing, high-capacity merchandise display which includes a plurality of modular receptacle means for transporting, storing and displaying large quantities of merchandise reducing retail labor requirements.

It is yet another advantage of the present invention to provide a free-standing, high-capacity merchandise display which includes modular receptacle means for transporting, stocking and replenishing differing quantities of sold merchandise further reducing retail labor requirements.

It is yet a further advantage of the present invention to provide a free-standing, high-capacity merchandise display which includes greater surface area for the presentation of marketing information and/or reflective surfaces providing a more attractive display.

It is still another advantage of the present invention to provide a free-standing, high-capacity merchandise display which is simple to construct.

It is still another advantage of the present invention to provide a free-standing, high-capacity merchandise display which is constructed of light-weight materials for relative ease of movement and relocation of the display with little labor.

These and other further advantages of the present invention will no doubt become apparent to those skilled in the art from the following drawings, detailed description of the preferred embodiment and appended claims.

IN THE DRAWINGS

DETAILED DESCRIPTION OF THE PREFERRED EMBODIMENTS

The following detailed description illustrates the invention by way of example, not be way of limitation of the principals of the invention. This description will enable one skilled in the art to make and use the invention, and describe several embodiments, adaptations, variations, alternatives and uses of the invention, including what we presently believe as the best mode of carrying out the invention.

Figure 1:
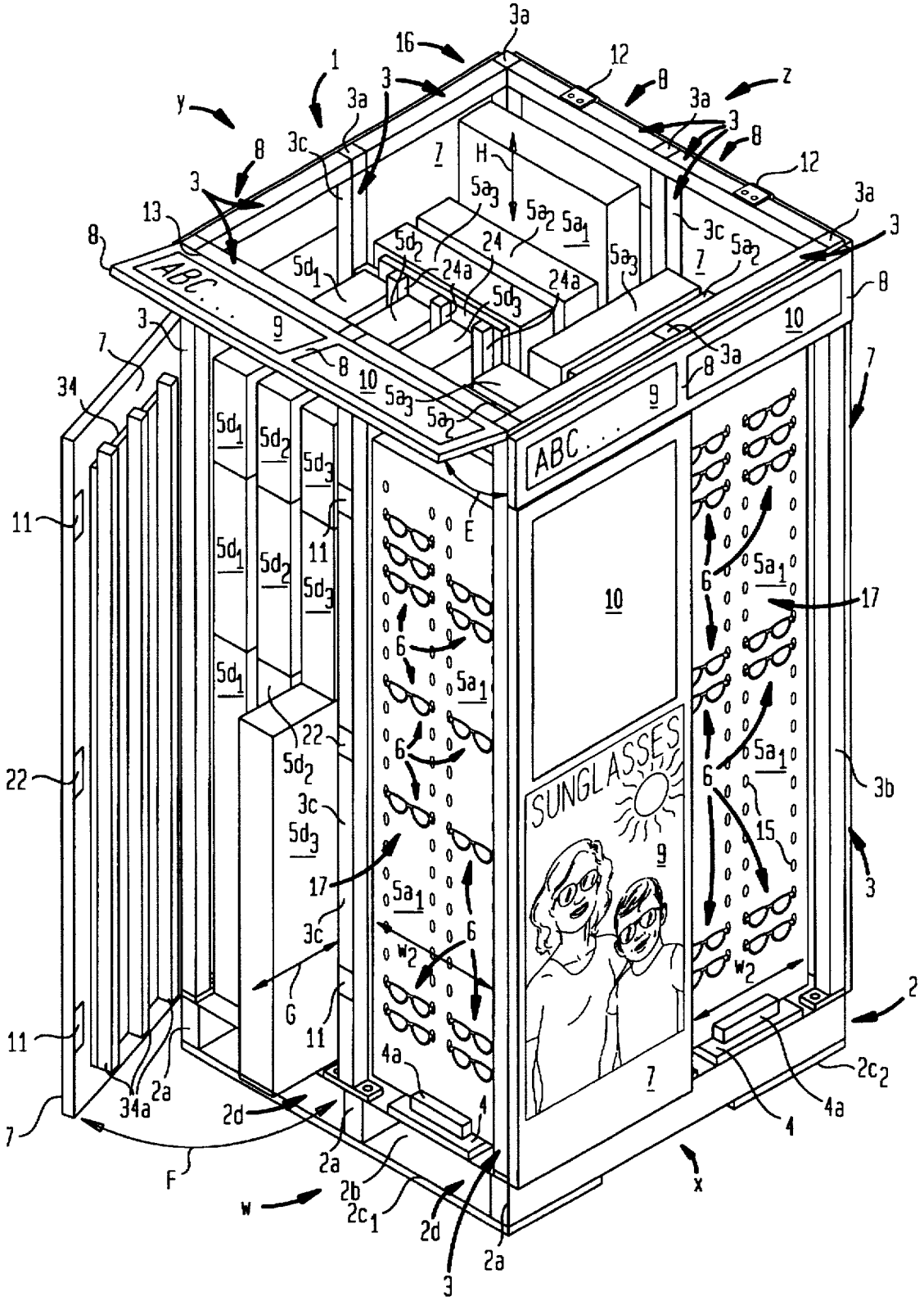
FIG. 1 is a perspective view of the merchandise transport, storage and display apparatus and merchandise receptacle system of the present invention.

With reference now to the drawings and in particular to FIG. 1 thereof, there is shown a merchandise transport, storage and display apparatus and merchandise receptacle system in accordance with various embodiments of the present invention and indicated general by the reference numeral 1.

The display apparatus 1 is generally defined as a vertical, free-standing, floor merchandising display broadly comprising a pallet base assembly $2a$–$c_{1-2}$, a frame assembly $3a$–$e$, merchandise receptacle positioning guides 4–4$a$, 14–14$a$, 24–24$a$, 34–34$a$, merchandise receptacles $5a_{1-3}$–$5d_{1-3}$ bearing receivingly engaged merchandise 6, comprising sunglasses by way of example, side access panels 7, and header access panels 8.

Pallet base assembly 2 may be constructed of wood comprising an assembly of 2"×4" studs 2$a$ positioned in parallel orientation and intermediately engaged by nail between square upper sheet 2$b$ and opposing lower slats $2c_1$ and $2c_2$. Pallet base assembly 2 includes opposing open ends ("throughways") 2$d$ through which the forks of a fork lift or palate jack may be inserted providing means for lifting and moving ("transporting") display apparatus 1 while loaded or unloaded with merchandise receptacles $5a_{1-3}$–$5d_{1-3}$. Pallet base assembly 2 is preferably constructed of wood. However, it can be readily understood by one skilled in the art that suitable alternative materials such as plastic or metal can be used.

Referring further to FIG. 1, frame assembly 3 is constructed of a plurality of sections of metal tubing connected by tube assembling devices 3$a$ as described fully in U.S. Pat. No. 4,368,998 issued to Pestoor, et al. Frame assembly 3 is preferably constructed of aluminum alloy. In the alternative, frame assembly 3 may be constructed of wood, steel or plastic. As is discussed more fully herein below, frame assembly 3 includes vertical corner members 3$b$ and vertical medial members 3$c$, which are spaced apart a horizontal distance $w_2$ and which define the external vertical edge of merchandise access ports 17.

Side access panels 7 and header panels 8 are removably engaged to frame assembly 3 by velcro fasteners 11, or alternatively hinges 12, or clear strip adhesive tape 13, or magnets 22. Side access panels 7 and header panels 8 are preferably constructed of light weight corrugated cardboard. In the alternative, said panels 7 and 8 may be comprised of plastic or light gauge sheet metal. Side access panels 7 and header panels 8 can have affixed thereto by adhesive, marketing material 9 or reflective surfaces 10 and/or a combination of both as shown in FIG. 1. Marketing material 9 may include poster art or soft adhesive labels including trademarks, trade names, sales information and/or attractive designs or pictures. Reflective surfaces 10 may include such items as light weight mirrors or reflective self adhesive tape.

Figure 2:
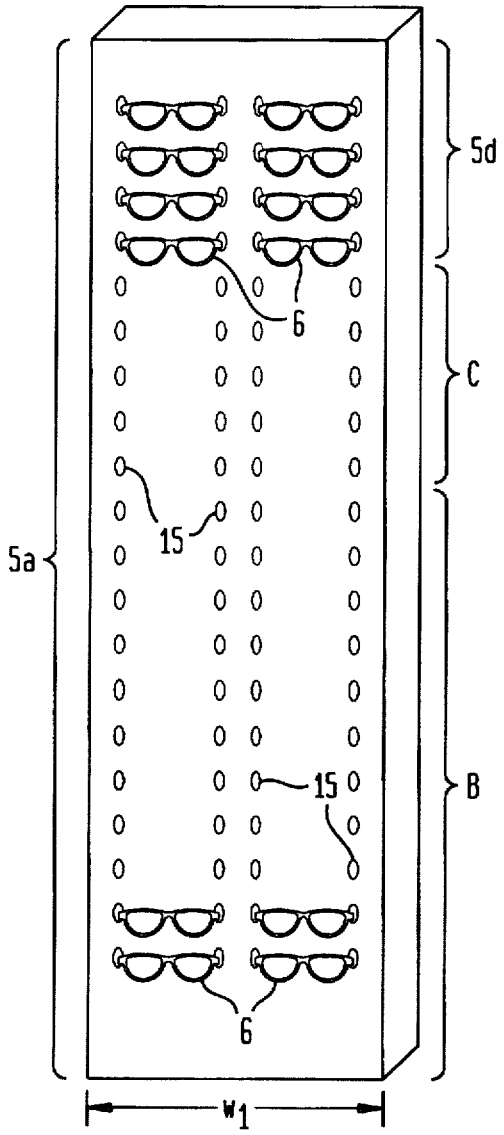
FIG. 2 is a perspective view of a merchandise receptacle of the display system.

Referring now to FIGS. 1 and 2, there is shown merchandise receptacles $5a_{1-3}$–$5d_{1-3}$. Said merchandise receptacles $5a_{1-3}$–$5d_{1-3}$ are rectangular boxes having a width $w_1$ and a length of 5$a$, 5$b$, 5$c$ or 5$d$, as may be desired by the manufacturer or retailer and are constructed of corrugated cardboard or alternatively plastic. Width "$w_1$" of said receptacles is larger than width "$w_2$" of merchandise access ports 17 such that when merchandise receptacles $5a_{1-3}$–$5d_{1-3}$ are in place, vertical tube members 3$b$ and 3$c$ act as a stop keeping receptacles $5a_{1-3}$–$5d_{1-3}$ from falling out of access port 17. Each receptacle includes two equally distanced columns and rows of aperture means 15 for receivingly engaging portions of merchandise 6. While apertures means 15 are shown by way of example, it can be understood by one skilled in the art that other equivalent engagement or hanging means such as ties, staples or small cantilevers or a combination of them may be employed to engage packaged or unpackaged merchandise to receptacles $5a_{1-3}$–$5d_{1-3}$ as desired and/or as required by the specific nature of the merchandise to be displayed. Merchandise receptacles $5a_{1-3}$–$5d_{1}3$ are preloaded with merchandise 6 by the manufacturer or distributor prior to insertion into display apparatus 1 and prior to shipment to the retail store location. Once merchandise receptacles $5a_{1-3}$–$5d_{1-3}$ are fully loaded with merchandise 6, each receptacle $5a_{1-3}$–$5d_{1-3}$ can be wrapped in plastic (not shown) to protect the merchandise 6 from unintentionally disengaging from the receptacle. Each receptacle $5a_{1-3}$–$5d_{1-3}$ is individually positioned within the raised portions 4$a$, 14$a$, 24$a$ and 34$a$ of receptacle positioning guides 4, 14, 24 and 34 within frame assembly 3 of display apparatus 1 for shipment as is more fully discussed herein below.

Figure 3:
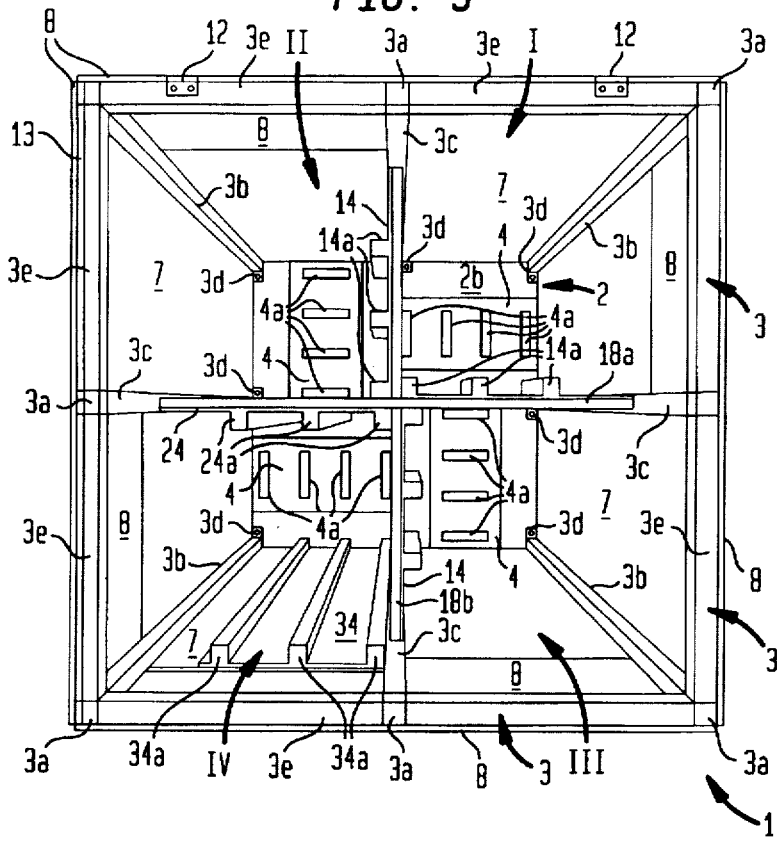
FIG. 3 is a perspective view of the display apparatus shown in FIG. 1 from the top with internal merchandise receptacles removed to reveal the internal frame structure and receptacle positioning means.

Referring now to FIG. 3, there is shown a perspective view of the display apparatus 1 of FIG. 1 from the top with merchandise receptacles $5a_{1-3}$–$5d_{1-3}$ (FIG. 1) removed revealing in further detail the construction of display apparatus 1. There is revealed the whole of frame assembly 3 which comprises: four vertical end frame tube sections 3$b$, four of the lower ends of which are engaged by screws to the respective corners of top sheet 2$b$ of pallet base assembly 2 by connectors 3$d$, four vertical medial frame tube sections 3$c$ having four lower ends of which are engaged by screws medially of each respective corner of top sheet 2$b$; and, eight horizontal upper frame tube sections 3$e$, each end of which is connected to an end of another horizontal frame tube 3$e$ and an upper end of a vertical frame tube section 3$b$ or 3$c$ utilizing connection 3$a$, thus forming the whole of frame assembly 3 in the configuration as shown in FIG. 3.

Referring further to FIG. 3, upper cross-support members 18$a$, 18$b$ are respectively engaged to and between the upper portions of each vertical medial frame tube (along the vertical medial line (not shown)) 3$c$ providing means for lateral structural support of the upper portion of frame assembly 3 and to provide a support means for the attachment of merchandise receptacle positioning guides 14 and 24. Likewise, (as is best seen in FIG. 5) opposing lower wood cross-support members 19*a*, 19*b* are respectfully engaged to and between the lower portions of each vertical medial frame tube (along the vertical medial line (not shown)) 3*c* providing means for lateral structural support of the lower portion of frame assembly 3 and to provide a support means for attachment of merchandise receptacle positioning guide 24 (as is best seen in FIG. 5).

Figure 4:
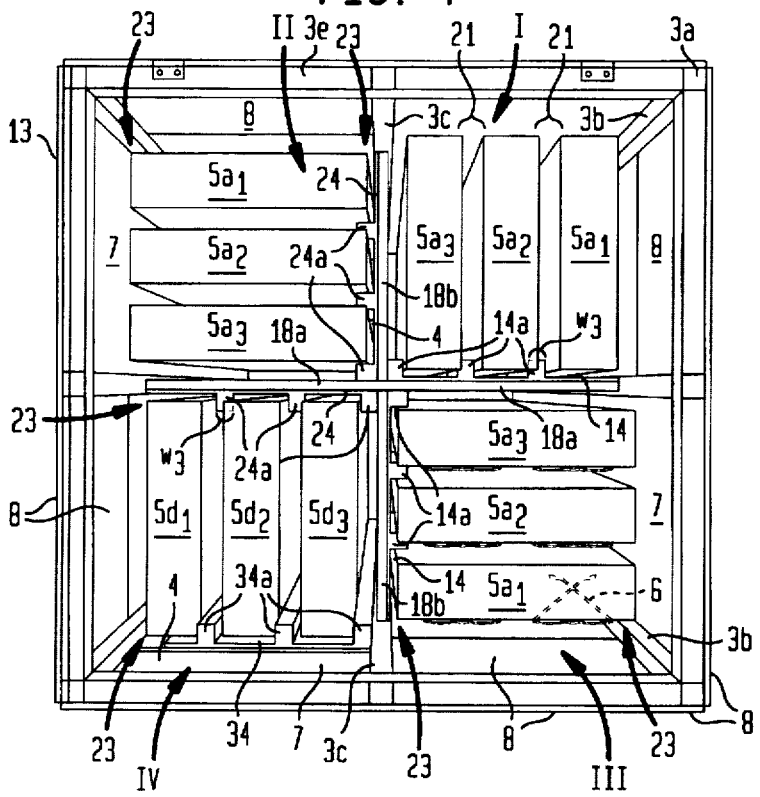
FIG. 4 is a perspective view from the top of the display apparatus shown in FIG. 1 wherein the merchandise receptacles are in position within the display.

In further reference to FIG. 3, Upper and lower cross-members 18*a*, 18*b* and 19*a*, 19*b* divide display apparatus 1 internally into four vertical compartments I, II, III and IV of equal dimension. Each compartment I, II, III and IV includes merchandise receptacle positioning guides 4 fastened by nail or alternatively, screw, staple or adhesive to the top sheet 2*b* of pallet base assembly 2 and to cross-members 18 and/or 19. Each merchandise positioning guide 4, 14, 24 and 34 is preferably constructed of a single piece of sheet plastic with molded raised portions 4*a*, 14*a*, 24*a* and 34*a* between which the merchandise receptacles $5a_{1-3}$–$5d_{1-3}$ are respectively positioned, as is best seen in FIG. 4 and discussed more fully herein below. However, it can be appreciated by one skilled in the art that alternative materials to plastic such as wood or metal alloys can be used. For full-size merchandise receptacles 5*a* (see FIG. 2), positioning guides need only be attached to pallet sheet 2*b* and upper cross-member 18*a*, 18*b* to properly position the receptacle. However, for each compartment in which it is desired to use less than a full-size merchandise receptacle, such as lengths 5*b*–*d*, two opposing, single-piece merchandise receptacle guides 24 and 34 (of a dimension longer than that of a full-size merchandise receptacle), are used: one single-piece guide 34 affixed by adhesive to the interior surface 7*a* of access panel 7 and the other single-piece guide 24 affixed to the upper and lower cross-members 18*a* and 19*a* as is best seen in FIG. 5. For either alternative, each compartment is universally capable of holding three large-size merchandise receptacles 5*a* or the equivalent thereof in the smaller sized merchandise receptacles 5*b*–*d*.

Referring now to FIG. 4, there is shown a perspective view of the display apparatus of FIG. 1 from the top where merchandise receptacles $5a_{1-3}$–$5d_{1-3}$ are shown in place in each of compartments I, II, III and IV. Within each compartment I, II, III, and IV, each of merchandise receptacles $5a_{1-3}$–$5d_{1-3}$ is equadistantally nested (horizontally) and separated loosely one from the other by the raised portions 14*a* and 24*a* of positioning guides 14 and 24 respectively attached to cross-members 18*a*, 18*b*. Said raised portions 14*a* and 24*a* of positioning guides 14 and 24 are respectively of width $w_3$ creating sufficient space 21 between said receptacles to permit the insertion, removal and replacement of fully loaded receptacles $5a_{1-3}$–$5d_{1-3}$ without interference one from the other and merchandise 6. Outer front-side edges 23 of receptacles $5a_1$ and $5d_1$ respectively abut loosely against vertical corner members 3*b* and vertical medial members 3*c*.

Figure 5:
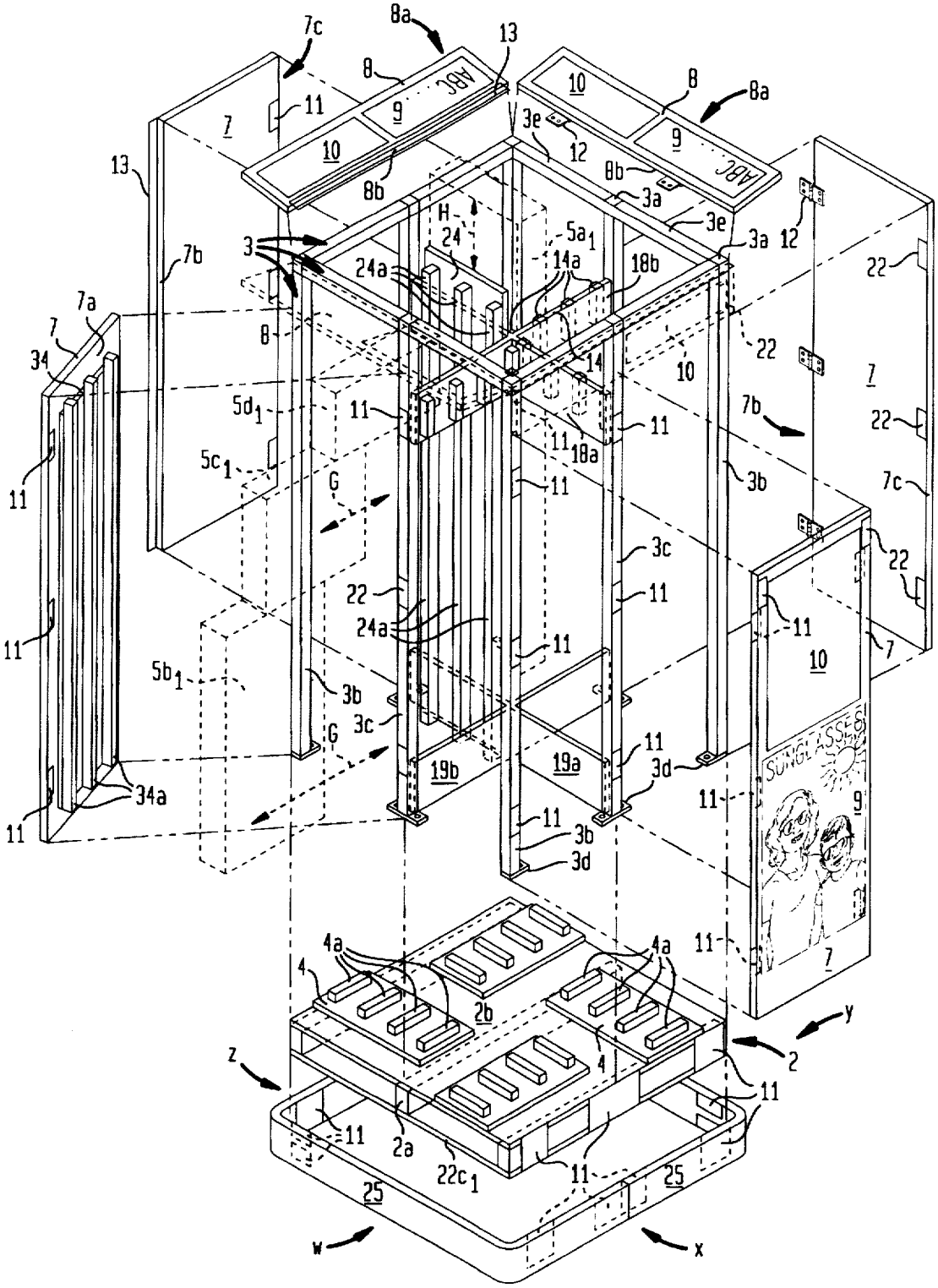
FIG. 5 is an exploded perspective view of the display apparatus of the invention shown in FIG. 1.

Referring now to FIG. 5, there is shown an exploded perspective view of display apparatus 1 in FIG. 1 to further illustrate the construction and component parts of the invention.

Referring now specifically to FIG. 5, there is further shown in perspective view frame assembly 3 comprising horizontal upper frame tube sections 3*e* and vertical corner and medial members 3*b* and 3*c* which are integrally connected by together as shown by connectors 3*a* and the whole (assembly 3) of which is screwed or bolted to pallet sheet 2*b* through connectors 3*d*.

There is further shown in FIG. 5 the upper and lower transverse cross-members 18*a*, 18*b* and 19*a*, 19*b* which are respectively screwed or alternatively bolted, to vertical medial members 3*c* and to which are attached merchandise positioning guides 14 and 24 with respective raised portions 14*a* and 24*a* which spatially correspond with the merchandise positioning guides 4 with raised portions 4*a* attached to pallet sheet 2*b* for the positioning of merchandise receptacles $5a_{1-3}$–$5d_{1-3}$ (FIGS. 1 and 4). Referring to sides X, Y, and Z, there is shown one embodiment of corresponding positioning guides 14 suitable for the positioning of merchandise receptacles of length 5*a* (FIG. 2) as shown in ghost $5a_1$. Referring to side W there is shown an alternative embodiment of opposing elongated positioning guides 24 and 34, one guide 34 attached to the interior surface 7*a* of side panel 7 and the other guide 24 engaged to upper and lower cross-members 18*a* and 19*a*, together suitable for the positioning of merchandise receptacles of length 5*a* and more particularly lengths 5*b*, 5*c* and 5*d* as shown in ghost $5b_1$, $5c_1$, and $5c_1$.

Referring further to FIG. 5, there is further shown side access panels 7 and header panels 8 which may be removably affixed to frame assembly 3 by velcro fasteners as illustrated on display side Y (header panel 8 shown in non-exploded, fixed position). Alternatively, access panels 7 and header panels 8 may be swingingly affixed on one side edge 7*b* and 8*b* to frame assembly 3 by hinge 12 as shown on display side Y or by adhesive tape 13 as shown on display side Z. The opposing side edge 7*c* of said swingingly engaged panels 7 may be removably engaged to vertical corner or medial frame members 3*b* or 3*c* by velcro fasteners 11 as shown on display side W and Z or by magnet 22 as shown on display side Y. The opposing side edge 8*a* of said swingingly engaged header panels 8 is held down and over the exterior surface of side panels 7 naturally by gravity or alternative by velcro fastener 11 or magnet 22 as shown on display side X.

In further reference to FIG. 5, there is illustrated in ghost merchandise receptacles $5a_1$, $5b_1$, $5c_1$ and $5d_1$ to further illustrate the two embodiments in which said merchandise receptacles can be inserted and removed from the display apparatus 1 along the lines and in the direction of arrows H (preferred) and G (alternative).

In further reference to FIG. 5, there is shown pallet base assembly 2 illustrating the positioning of merchandise positioning guides 4 thereon. Also shown for the first time is pallet base side cover 25 which removably engages to the exterior sides of pallet base assembly 2 by velcro fasteners 11 to provide an attractive finish to pallet base assembly 2 when at the retail location.

Referring now to FIGS. 1 and 5, the positioning of merchandise receptacles $5a_{1-3}$–$5d_{1-3}$ in display apparatus 1 is accomplished by first disengaging header panel 8 from frame assembly 3 or in the alternative swingingly open panel 8 upward along the line of arrow E as shown on side W of display apparatus 1 in FIG. 1 and secondly, disengaging side access panel 7 from frame assembly 3 or in the alternative, swingingly open access panel 7 outward along the line of arrow F as shown on side W of display apparatus 1 of FIG. 1. Merchandise receptacles $5a_{1-3}$–$5d_{1-3}$ may be inserted, repositioned, replaced and/or removed from each respective side W, X, Y or Z along the line of arrow G as shown on side W of display apparatus 1, by way of example. In the alternative, merchandise receptacles $5a_{1-3}$–$5d_{1-3}$ may be inserted, repositioned, replaced and/or removed vertically through the open top 16 of apparatus 1 along the line of arrow H as shown on side Z of display apparatus 1 in FIG. 1.

Once display apparatus 1 is fully loaded with preloaded merchandise receptacles $5a_{1-3}$–$5d_{1-3}$, display apparatus 1 can be shipped to the retail location in a standard shipping carton (not shown) or alternatively wrapped in protective plastic or paper (not shown). In each case, palate base assembly 2 is left uncovered and accessible by forklift or palate jack for ease of movement and transportation of display apparatus 1.

Once the display apparatus 1 is shipped to the retail store location, the retailer removes any shipping carton or wrap and the plastic wrap on the merchandise receptacles $5a_1$–$5d_1$ which are accessible and movable reaching through the exterior merchandise access ports 17. The remaining merchandise receptacles $5a_{2\text{-}3}$–$5d_{2\text{-}3}$ stored in-board of the merchandise receptacles $5a_1$–$5d_1$ remain wrapped to protect stored merchandise 6 from exposure to dust, moisture and other undesirable elements. With all side access panels 7 and header panels 8 engaged ("closed") against frame assembly 3, the retailer positions the display apparatus 1 at a desirable location on the floor of the retail store where each side W, X, Y, and Z is accessible by consumers and attaches pallet base cover 25 to pallet base assembly 2. As consumers remove and deplete the inventory of accessible merchandise 6 from merchandise receptacles $5a_1$–$5d_1$, the retailer can access, remove and replace as described above empty or near empty receptacles with fully stocked receptacles stored in the interior of display apparatus 1 as needed. When merchandise receptacles $5a_{1\text{-}3}$–$5d_{1\text{-}3}$ are depleted of merchandise 6, the entire display apparatus 1 and all merchandise receptacles $5a_{1\text{-}3}$–$5d_{1\text{-}3}$ can be replaced with a new fully preloaded display apparatus 1 or in the alternative, each individual merchandise receptacle $5a_{1\text{-}3}$–$5d_{1\text{-}3}$ can be replaced with a new preloaded receptacle obtained from the manufacturer and/or distributor. The invention as above described thus provides the retailer a complete system for the transport, storage, display and replenishment of merchandise within one modularized display apparatus.

It should be understood that various modifications within the scope of this invention can be made by one of ordinary skill in the art without departing from the spirit thereof. I therefore wish my invention to be defined by the scope of the appended claims as broadly as the prior art will permit, and to cover all alternatives and modifications as fall within the true spirit and scope of the invention.

What I claim is:

1. A merchandise transport, storage, and display apparatus, comprising:

a base assembly;

a frame assembly engaged to said base assembly;

first and second plurality of merchandise receptacles;

positioning means for positioning said first plurality of merchandise receptacles for display of merchandise;

concealing means for concealing said second plurality of merchandise receptacles within said frame assembly, which concealing means comprises at least one panel in movable engagement with said frame; and wherein said second plurality of merchandise receptacles are stored behind and adjacent to said first plurality of merchandise receptacles.

2. The merchandise transport, storage and display apparatus of claim 1 wherein said concealing means is engaged to said base assembly.

3. The merchandise transport, storage and display apparatus claim 1, wherein said positioning means is engaged to said frame assembly.

4. The merchandise transport, storage and display apparatus of claim 1 wherein said base assembly includes means for transporting said display apparatus.

5. The merchandise transport, storage and display apparatus of claim 4 wherein said base assembly means for transporting said display apparatus comprises a pallet including throughways for facilitating the lifting and movement of said display apparatus by pallet jack and fork lift.

6. The merchandise transport, storage and display apparatus of claim 1 wherein said positioning means comprises at least one first positioning guide cooperating with said concealing means for the positioning of at least one of said merchandise receptacles of said first plurality within said frame assembly.

7. A merchandise transport, storage and display apparatus of claim 1 wherein said frame assembly comprises a plurality of interconnected tube members including:

vertical corner members each having an upper and lower end, each of said lower ends being respectively engaged to a corner of said base assembly;

vertical medial members each having an upper and lower end, each of said lower ends being respectively engaged to said base assembly medial of said vertical corner members; and horizontal members each having first and second ends, said first ends being connected to said upper ends of said vertical corner members and said second ends being connected to said upper ends of said vertical medial members.

8. The merchandise transport, storage and display apparatus of claim 7 wherein said concealing means includes at least one transverse cross-member engaged to and between at least one of said vertical medial members of said frame assembly.

9. The merchandise transport, storage and display apparatus of claim 8 wherein said concealing means further includes at least one positioning guide engaged to at least one of said transverse cross-members for the positioning of at least one of said merchandise receptacles of said second plurality within said frame assembly.

10. A merchandise transport, storage and display apparatus as described in claim 1 wherein said merchandise receptacles include removably engaged merchandise.

11. The merchandise transport, storage and display apparatus of claim 1, wherein said panel includes guide means for positioning merchandise receptacles concealed within said frame assembly.

12. The merchandise transport, storage and display apparatus of claim 11, wherein said guide means includes at least two positioning guides cooperating with each other for the positioning of a particular merchandise receptacle.

13. The merchandise transport, storage and display apparatus of claim 1 wherein said panel is removably engaged to said frame assembly by attachment means from the group consisting of velcro, hinge, adhesive tape and magnets.

14. The merchandise transport, storage and display apparatus claim 1, wherein said panel is a side panel.

15. A merchandise transport, storage and display apparatus as described in claim 14 wherein said side panel includes marketing material affixed thereon.

16. A merchandise transport, storage and display apparatus as described in claim 14 wherein said side panel includes means for reflecting images affixed thereon.

17. The merchandise transport, storage and display apparatus claim 1 wherein said panel is a header panel.

18. A merchandise transport, storage and display apparatus as described in claim 17 wherein said header panel includes marketing material affixed thereon.

19. A merchandise transport, storage and display apparatus as described in claim 17 wherein said header panel includes means for reflecting images affixed thereon.

20. A merchandise transport, storage and display apparatus as described in claim 1 including a side cover removably engaged to said base assembly.

21. A merchandise transport, storage and display apparatus comprising:

a base assembly;

a frame assembly engaged to said base assembly;

at least one first positioning guide engaged to said base assembly;

at least one second positioning guide engaged to said frame assembly;

a plurality of merchandise receptacles, said receptacles being positionable within said frame assembly;

said first positioning guide cooperating with said second positioning guide for positioning said merchandise receptacles within said frame assembly; and a plurality of panels removably engaged to said frame assembly for concealing said plurality of merchandise receptacles excepting at least one of said merchandise receptacles when said merchandise receptacles are removably engaged within said frame assembly and said panels are engaged to said frame assembly.

22. A merchandise transport, storage and display apparatus as described in claim 21 including a third positioning guide engaged to at least one of said panels and cooperating with said first and second positioning guides for positioning at least one of said merchandise receptacles within said frame assembly.

23. A merchandise transport, storage and display apparatus as described in claim 22 wherein said merchandise receptacles include removably engaged merchandise.

24. A merchandise transport, storage and display apparatus comprising:

a base assembly;

a frame assembly being engaged to said base assembly including a plurality of interconnected tube members including:

vertical corner members each having an upper and lower end, each of said lower ends being respectively engaged to a corner of said base assembly;

vertical medial members each having an upper and lower end, each of said lower ends being respectively engaged to said base assembly medial of said vertical corner members; and horizontal members each having first and second ends, said first ends being connected to said upper ends of said vertical corner members and said second ends being connected to said upper ends of said vertical medial members;

at least one transverse cross-member engaged to and between at least one of said vertical medial members of said frame assembly;

at least one first positioning guide engaged to said base assembly;

at least one second positioning guide engaged to said transverse cross-member;

a plurality of merchandise receptacles, said receptacles being positionable within said frame assembly;

said first positioning guide cooperating with said second positioning guide for positioning at least one of said merchandise receptacles within said frame assembly; and a plurality of panels removably engaged to said frame assembly for concealing said merchandise receptacles excepting at least one of said merchandise receptacles when said merchandise receptacles are positioned within said frame assembly and said panels are engaged to said frame assembly.

25. A merchandise transport, storage and display apparatus as described in claim 24 including a third positioning guide engaged to at least one of said panels and cooperating with said first and second positioning guides for the positioning of at least one of said merchandise receptacles within said frame assembly.

26. A merchandise transport, storage and display apparatus as described in claim 25 wherein said merchandise receptacles include removably engaged merchandise.

* * * * *